US011391475B2

(12) United States Patent
Wu et al.

(10) Patent No.: US 11,391,475 B2
(45) Date of Patent: Jul. 19, 2022

(54) RADIANT AIR CONDITIONING SYSTEM FOR CONTROLLING COMFORTABLE AND HEALTHY INDOOR ENVIRONMENT BASED ON INFRARED SENSING TECHNOLOGY

(71) Applicant: DALIAN UNIVERSITY OF TECHNOLOGY, Liaoning (CN)

(72) Inventors: Xiaozhou Wu, Liaoning (CN); Haichao Wang, Liaoning (CN); Yu Zhao, Liaoning (CN); Shugang Wang, Liaoning (CN); Jihong Wang, Liaoning (CN)

(73) Assignee: DALIAN UNIVERSITY OF TECHNOLOGY, Liaoning (CN)

( * ) Notice: Subject to any disclaimer, the term of this patent is extended or adjusted under 35 U.S.C. 154(b) by 211 days.

(21) Appl. No.: 16/769,415

(22) PCT Filed: Jan. 2, 2019

(86) PCT No.: PCT/CN2019/070072

§ 371 (c)(1),
(2) Date: Jun. 3, 2020

(87) PCT Pub. No.: WO2020/140196

PCT Pub. Date: Jul. 9, 2020

(65) Prior Publication Data

US 2021/0095882 A1 Apr. 1, 2021

(51) Int. Cl.
*F24F 5/00* (2006.01)
*F24F 11/74* (2018.01)
(Continued)

(52) U.S. Cl.
CPC ..... *F24F 5/0089* (2013.01); *F24F 3/14* (2013.01); *F24F 5/0092* (2013.01); *F24F 7/007* (2013.01);
(Continued)

(58) Field of Classification Search
CPC ..... F24D 3/12; F24D 3/14; F24D 3/16; F24D 3/18; F24F 5/0089; F24F 5/0092;
(Continued)

(56) References Cited

U.S. PATENT DOCUMENTS 2,190,822 A * 2/1940 Byland ..... F24F 5/0089 62/331
3,200,606 A * 8/1965 Hewett ..... F24F 5/0089 62/271

(Continued)

FOREIGN PATENT DOCUMENTS

CN 201225728 Y 4/2009
CN 102213470 A 10/2011

(Continued)

*Primary Examiner* — Nelson J Nieves
(74) *Attorney, Agent, or Firm* — Muncy, Geissler, Olds & Lowe, P.C.

(57) ABSTRACT

A radiant air conditioning system for controlling comfortable and healthy indoor environment based on infrared sensing technology is disclosed, which comprises air source heat pump outdoor unit, plate evaporator, circulating water pump, etc. Accurate control of air humidity by installing an indoor dehumidification terminal can reduce the surface temperature of radiant cooling terminal and increase the installed area, which will significantly improve the radiant heat exchange between the terminal surface and the human body surface. Infrared sensor technology, which is adopted to obtain the number of indoor occupants and the required outdoor air flow rate, is integrated with a decoupling control of the indoor humidity and air freshness for the accurate control of outdoor air flow rate, and then the supply outdoor air temperature and humidity are regulated for the accurate control of indoor health level.

3 Claims, 1 Drawing Sheet

(51) Int. Cl.

| | |
|---|---|
| ***F24F 3/14*** | (2006.01) |
| ***F24F 7/007*** | (2006.01) |
| *F24F 110/20* | (2018.01) |
| *F24F 120/10* | (2018.01) |

(52) U.S. Cl.
CPC ..... *F24F 11/74* (2018.01); *F24F 2110/20* (2018.01); *F24F 2120/10* (2018.01)

(58) Field of Classification Search
CPC ..... F24F 11/74; F24F 3/14; F24F 2110/20; F24F 2120/10
See application file for complete search history.

(56) References Cited

U.S. PATENT DOCUMENTS

| | | | | | |
|---|---|---|---|---|---|
| 3,220,212 | A * | 11/1965 | Fordsmand | F25B 29/00 | 62/186 |
| 4,488,408 | A * | 12/1984 | Kajitsuka | F24F 3/1423 | 62/235.1 |
| 4,987,748 | A * | 1/1991 | Meckler | F24F 5/0089 | 62/271 |
| 5,131,238 | A * | 7/1992 | Meckler | F24F 1/00 | 62/271 |
| 5,181,387 | A * | 1/1993 | Meckler | F24F 5/0035 | 62/93 |
| 7,685,835 | B2 * | 3/2010 | Yoshimi | F24F 5/0089 | 62/324.1 |
| 11,060,740 | B2 * | 7/2021 | Michaud | F24F 11/74 | |
| 2005/0086958 | A1 * | 4/2005 | Walsh | F24F 11/30 | 62/201 |
| 2007/0234744 | A1 * | 10/2007 | Yoshimi | F24F 3/044 | 62/113 |
| 2009/0306828 | A1 * | 12/2009 | Larsen | F24F 11/30 | 700/276 |
| 2011/0259025 | A1 * | 10/2011 | Noh | F24D 3/18 | 62/160 |
| 2011/0259027 | A1 * | 10/2011 | Choi | F24F 1/0003 | 62/238.7 |
| 2012/0042673 | A1 * | 2/2012 | Noh | G06Q 30/02 | 62/159 |
| 2012/0043390 | A1 * | 2/2012 | Noh | G05D 23/1923 | 62/238.7 |
| 2014/0284391 | A1 * | 9/2014 | Schmidlin | F24D 19/1015 | 236/1 C |
| 2018/0003418 | A1 * | 1/2018 | Hu | F25B 30/02 | |
| 2018/0172296 | A1 * | 6/2018 | Buff | F24F 13/22 | |
| 2018/0347846 | A1 * | 12/2018 | Tamaki | F25B 6/02 | |
| 2020/0124357 | A1 * | 4/2020 | Kim | F24H 6/00 | |
| 2020/0278135 | A1 * | 9/2020 | Park | F25B 30/06 | |
| 2020/0378618 | A1 * | 12/2020 | Hall | F24D 3/16 | |

FOREIGN PATENT DOCUMENTS

| | | | | |
|---|---|---|---|---|
| CN | 107270447 | A | 10/2017 | |
| CN | 107300242 | A | 10/2017 | |
| CN | 207035387 | U | 2/2018 | |
| CN | 207196771 | U | 4/2018 | |
| CN | 108826550 | A | 11/2018 | |
| JP | 2008051468 | A * | 3/2008 | F24F 5/0089 |
| JP | 2012052792 | A * | 3/2012 | F24D 3/14 |
| KR | 20120056014 | A | 6/2012 | |

* cited by examiner

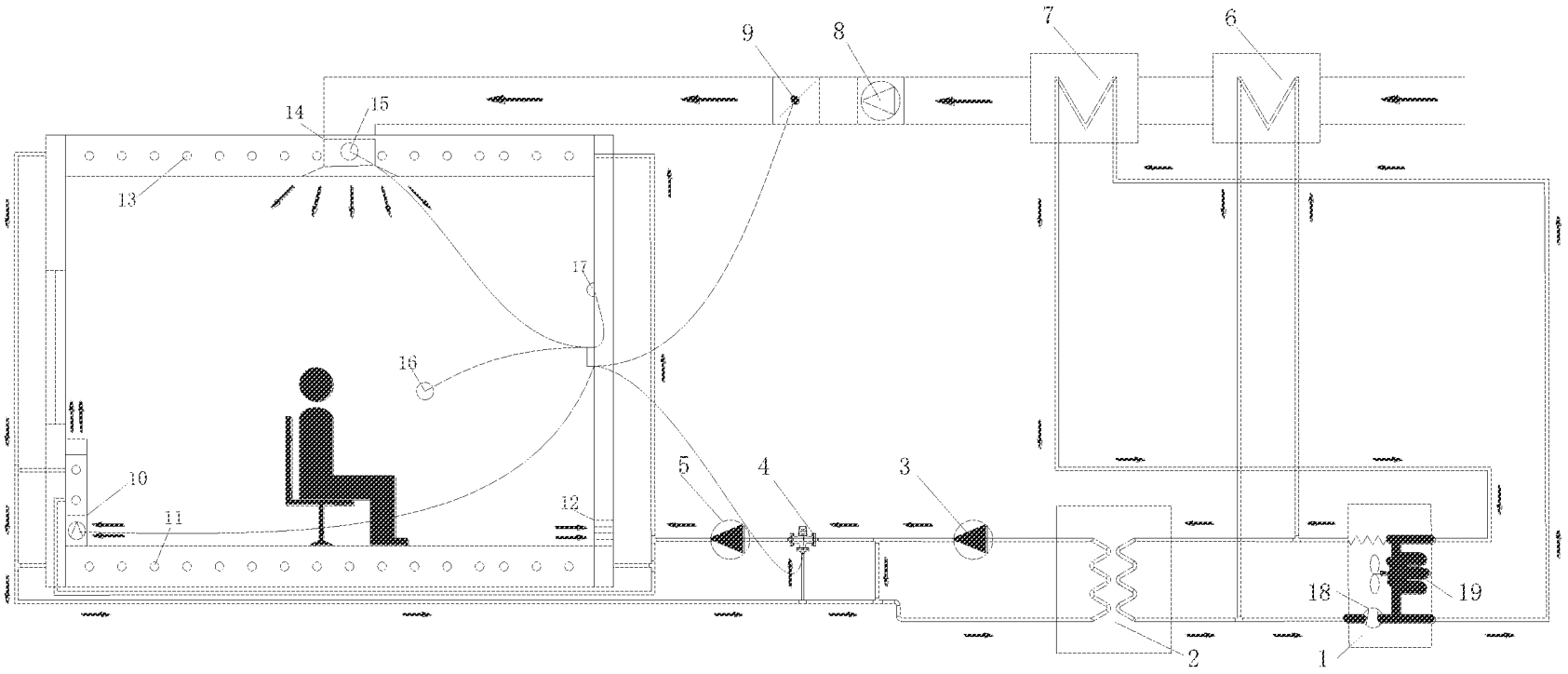
1
2
3
4
5
6
7
8
9
10
11
12
13
14
15
16
17
18
19

RADIANT AIR CONDITIONING SYSTEM FOR CONTROLLING COMFORTABLE AND HEALTHY INDOOR ENVIRONMENT BASED ON INFRARED SENSING TECHNOLOGY

TECHNICAL FIELD

The invention belongs to the field of heating ventilation air conditioning (HVAC) technology, and particularly relates to a radiant air conditioning system for controlling comfortable and healthy indoor environment based on infrared sensing technology.

BACKGROUND

With the continuous development of society and improvement of people's living standards, comfortable and healthy indoor environment has become the control target of air conditioning system. However, the current indoor control parameters of air conditioning system are generally air temperature and humidity and carbon dioxide concentration. According to the theory of thermal comfort and health, the direct parameters that affect human thermal comfort and health are human surface temperature and outdoor air flow rate. Indoor air temperature and humidity and carbon dioxide concentration, which are regards as indirect parameters that affect human thermal comfort and health and can be kept at a certain comfortable and healthy level, are difficult to fully meet the requirements of comfortable and healthy indoor environment. Therefore, in order to fully meet the requirements of comfortable and healthy indoor environment, human body surface temperature and outdoor air flow rate should be regarded as the indoor control parameters of the air conditioning system.

Radiant air conditioning system, which is regarded as a new type of temperature and humidity independent control air conditioning system, consists of radiant cooling system, dedicated outdoor air system and cool source. Compared with the traditional convection cooling terminal, the radiant cooling terminal can effectively control the human body surface temperature and comfort level, because it can directly affect the human body surface temperature through radiant heat exchange. The dedicated outdoor air system can supply outdoor air through ventilation to ensure the indoor health level. Therefore, if the design and control of radiant air conditioning system is reasonable, it should be able to fully meet the requirements of comfortable and healthy indoor environment.

However, the current indoor control parameters of radiant air conditioning system are still air temperature and humidity and carbon dioxide concentration, which cannot fully indicate the advantages of radiant air conditioning system. This is mainly due to the lack of indoor dehumidification terminal and complete relying on the dedicated outdoor air system for dehumidification, which resulting in that the dedicated outdoor air system not only controls the carbon dioxide concentration but also controls the air humidity. Due to the mutual influence of the controls of carbon dioxide concentration and air humidity which are all achieved by adjusting the outdoor air flow rate, the outdoor air flow rate cannot be accurately controlled and the indoor health level cannot be guaranteed. In addition, the surface temperature and installation area of the radiant cooling terminal are high and small, which leads to the insufficient radiant heat exchange between the radiant terminal surface and the human body surface, and the human body surface temperature and comfort level cannot be accurately controlled.

SUMMARY

The object of the present invention is to provide a radiant air conditioning system for controlling comfortable and healthy indoor environment based on infrared sensing technology. On the one hand, it can significantly increase intensity of the radiant heat exchange between the radiant terminal surface and the human body surface, and the human body surface temperature and comfort level can be accurately controlled. On the other hand, indoor outdoor air flow rate and health level can be also accurately controlled by decoupling control of indoor humidity and air freshness.

The technical solutions of the invention:

A radiant air conditioning system for controlling comfortable and healthy indoor environment based on infrared sensing technology is mainly composed of air source heat pump outdoor unit 1, air source heat pump indoor plate evaporator 2, water circulating pump 3, water mixing valve 4, water mixing pump 5, air source heat pump indoor finned evaporator 6, air source heat pump indoor finned condenser 7, fan 8, damper 9, unfolded installation dehumidified fan coil 10, radiant floor 11, exhaust outlet 12, radiant ceiling 13, outdoor air inlet 14, air speed sensor 15, temperature and humidity sensor 16 and infrared sensor 17.

The air source heat pump outdoor unit 1 is mainly consisted of an outdoor condenser and a compressor, which are respectively connected with the air source heat pump indoor plate evaporator 2, the air source heat pump indoor finned evaporator 6 and the air source heat pump indoor finned condenser 7 through refrigerant tubes. The air source heat pump indoor plate evaporator 2 is connected with the water circulating pump 3 through cold water pipes. The water circulating pump 3 is connected with the water mixing valve 4 and the water mixing pump 5. The water mixing pump 5 is respectively connected with the unfolded installation dehumidified fan coil 10, the radiant floor 11 and the radiant ceiling 13. The air source heat pump indoor finned evaporator 6 and the air source heat pump indoor finned condenser 7 are connected with the fans 8 and the damper 9 through air ducts, and the damper 9 is connected with the outdoor air inlet 14. The air speed sensor 15, temperature and humidity sensor 16 and infrared sensor 17 are connected with control center of the air conditioning system through signal lines. The control center of the air conditioning system is connected with the damper 9, the unfolded installation dehumidified fan coil 10 and the water mixing valve 4.

The control process of human body surface temperature and comfort level: the average surface temperature of the human body is obtained by monitoring the human body surface temperature using the infrared sensor 17, and then comparing with the set value for cooling or dehumidifying to keep the human body at a comfortable level. Cooling is achieving by transferring the cooling capacity generated by the air source heat pump indoor plate evaporator 2 to the radiant terminal surface through the radiant floor 11 and the radiant ceiling 13, and then dealing with the sensible heat generated by the human body surface through radiant heat exchange between the radiant terminal surface and the human body surface. Dehumidifying is achieving by transferring the cooling capacity generated by the air source heat pump indoor plate evaporator 2 to coil surface through the unfolded installation dehumidified fan coil 10, and then decreasing the supply air humidity with condensation and dehumidification and supplying it into the room to deal with the latent heat generated by the human body surface.

The control process of the outdoor air flow rate and healthy level: the number of indoor occupants and the required outdoor air flow rate are obtained by monitoring the human body surface temperature using the infrared sensors 17, and comparing with the set value to adjust the outdoor air flow rate for keeping human body at a healthy level. The adjustment of outdoor air flow rate is achieved by sending the measured outdoor air flow rate air with the air speed sensor 15 to the air conditioning system control center, which will adjust and control the opening degree of the damper 9. Meanwhile, outdoor air humidity is reduced by cooling and dehumidifying of the air source heat pump indoor finned evaporator 6, and then the supply outdoor air temperature is raised by heating of air source heat pump indoor finned condenser 7.

The beneficial effects of the invention:

1. Accurate control of air humidity by installing the indoor dehumidification terminal can reduce the surface temperature and installation area of the radiant cooling terminal, so as to significantly improve radiant heat exchange between the radiant terminal surface and the human body surface and to achieve accurate control of the human body surface temperature and comfortable level.

2. Infrared sensor technology is adopted to obtain the number of indoor occupants and the required outdoor air flow rate, so as to decouple control of the indoor humidity and air freshness for the accurate control of indoor outdoor air flow rate, and to regulate the supply outdoor air temperature and humidity for the accurate control of healthy level.

DESCRIPTION OF DRAWINGS

FIG. 1. Schematic diagram of the radiant air conditioning system for controlling comfortable and healthy indoor environment of the present invention.

Where: 1 air source heat pump outdoor unit; 2 air source heat pump indoor plate evaporator; 3 water circulating pump; 4 water mixing valve; 5 water mixing pump; 6 air source heat pump indoor finned evaporator; 7 air source heat pump indoor finned condenser; 8 fan; 9 damper; 10 unfolded installation dehumidified fan coil; 11 radiant floor; 12 exhaust outlet; 13 radiant ceiling; 14 outdoor air inlet; 15 air speed sensor; 16 temperature and humidity sensor; 17 infrared sensor; 18 compressor and 19 outdoor condenser.

DETAILED DESCRIPTION

The specific embodiments of the present invention are further described below in conjunction with the drawings and technical solutions.

As shown in FIG. 1, a radiant air conditioning system for controlling comfortable and healthy indoor environment based on infrared sensing technology is mainly composed of air source heat pump outdoor unit 1, air source heat pump indoor plate evaporator 2, water circulating pump 3, water mixing valve 4, water mixing pump 5, air source heat pump indoor finned evaporator 6, air source heat pump indoor finned condenser 7, fan 8, damper 9, unfolded installation dehumidified fan coil 10, radiant floor 11, exhaust outlet 12, radiant ceiling 13, outdoor air inlet 14, air speed sensor 15, temperature and humidity sensor 16 and infrared sensor 17.

As shown in FIG. 1, the air source heat pump outdoor unit 1 is mainly consisted of an outdoor condenser and a compressor, which are respectively connected with the air source heat pump indoor plate evaporator 2, the air source heat pump indoor finned evaporator 6 and the air source heat pump indoor finned condenser 7 through refrigerant tubes. The air source heat pump indoor plate evaporator 2 is connected with the water circulating pump 3 through cold water pipes. The water circulating pump 3 is connected with the water mixing valve 4 and the water mixing pump 5. The air source heat pump indoor finned evaporator 6 and the air source heat pump indoor finned condenser 7 are connected with the fan 8 and the damper 9 through air ducts.

The water mixing pump 5 is respectively connected with the unfolded installation dehumidified fan coil 10, the radiant floor 11 and the radiant ceiling 13. The air source heat pump indoor finned evaporator 6 and the air source heat pump indoor finned condenser 7 are connected with the fan 8 and the damper 9 through the air ducts, and the damper 9 is connected with the outdoor air inlet 14. The air speed sensor 15, temperature and humidity sensor 16 and infrared sensor 17 are connected with control center of the air conditioning system through the signal lines. The control center of the air conditioning system is connected with the damper 9, the unfolded installation dehumidified fan coil 10 and the water mixing valve 4.

The control process of human body surface temperature and comfort level is to mix water generated by the air source heat pump indoor plate evaporator 2 and return water from unfolded installation dehumidified fan coil 10, radiant floor 11 and radiant ceiling 13 through the mixing water valve 4, and send it into unfolded installation dehumidified fan coils 10, radiant floor 11 and radiant ceiling 13, and then adjust the opening degree of mixing water valve 4 and fan speed of unfolded installation dehumidified fan coil 10 according to the difference between measured and set value of indoor temperature and humidity sensor 16 and infrared sensor 17. Cooling is achieving by transferring the cooling capacity generated by the air source heat pump indoor plate evaporator 2 to the radiant terminal surface through the radiant floor 11 and the radiant ceiling 13, and then dealing with the sensible heat generated by the human body surface through radiant heat exchange between the radiant terminal surface and the human body surface. Dehumidifying is achieving by transferring the cooling capacity generated by the air source heat pump indoor plate evaporator 2 to coil surface through the unfolded installation dehumidified fan coil 10, and then decreasing the supply air humidity with condensation and dehumidification and supplying it into the room to deal with the latent heat generated by the human body surface, so as to realize the accurate control of the human body surface temperature and comfort level.

The control process of the outdoor air flow rate and healthy level is to supply outdoor air for cooling and dehumidifying through the air source heat pump indoor finned evaporator 6 by fan 8, and then supply outdoor air for heating through air source heat pump indoor finned condenser 7 and out exhaust outlet 14 to indoor. Meanwhile, infrared sensor 17 was used to monitor the surface temperature of the human body, and the number of indoor occupants and the required outdoor air flow rate were obtained through the algorithm, then the opening degree of the damper 9 was adjusted according to the measured value of the air speed sensor 15 to achieve accurate control of the outdoor air flow rate and health level.

In view of the above ideal embodiment of the present invention, those skilled in the art can completely make various changes and modifications without deviating from the technical idea of the invention based on the above described content. The technical scope of the invention is not limited to the contents of the specification, but must be determined according to the scope of claims.

The invention claimed is:

1. A radiant air conditioning system for controlling comfortable and healthy indoor environment based on infrared sensing technology, wherein the radiant air conditioning system for controlling comfortable and healthy indoor environment is consisting essentially of air source heat pump outdoor unit, air source heat pump indoor plate evaporator, water circulating pump, water mixing valve, water mixing pump, air source heat pump indoor finned evaporator, air source heat pump indoor finned condenser, fan, damper, unfolded installation dehumidified fan coil, radiant floor, exhaust outlet, radiant ceiling, outdoor air inlet, air speed sensor, temperature and humidity sensor and infrared sensor;

the air source heat pump outdoor unit is consisting essentially of an outdoor condenser and a compressor, which are respectively connected with the indoor plate evaporator, the air source heat pump indoor finned evaporator and the air source heat pump indoor finned condenser through refrigerant tubes; the air source heat pump indoor plate evaporator is connected with the water circulating pump through water pipes; the water circulating pump is connected with the water mixing valve and the water mixing pump; the water mixing pump is respectively connected with the unfolded installation dehumidified fan coil, the radiant floor and the radiant ceiling; the air source heat pump indoor finned evaporator and the air source heat pump indoor finned condenser are connected with the fan and the damper through air ducts, and the damper is connected with the outdoor air inlet; the air speed sensor, temperature and humidity sensor and infrared sensor are connected with control center as integrated into the air conditioning system through signal lines; the control center is connected with the damper, the unfolded installation dehumidified fan coil and the water mixing valve.

2. The radiant air conditioning system for controlling comfortable and healthy indoor environment according to claim 1, wherein an average surface temperature of human body is obtained by monitoring a human body surface temperature using the infrared sensor, and then comparing with a set value for cooling or dehumidifying to keep the human body surface temperature at a comfortable level; when cooling is needed, a cooling capacity generated by the air source heat pump indoor plate evaporator is transferred to a radiant terminal surface through the radiant floor and the radiant ceiling, and then sensible heat generated by a human body surface is dealt through radiant heat exchange between the radiant terminal surface and the human body surface; when dehumidifying is needed, the cooling capacity generated by the air source heat pump indoor plate evaporator is transferred to coil surface through the unfolded installation dehumidified fan coil, and then supply air humidity is decreased with condensation and dehumidification and is supplied into the room to deal with latent heat generated by the human body surface.

3. The radiant air conditioning system for controlling comfortable and healthy indoor environment according to claim 1, wherein a number of indoor occupants and a required outdoor air flow rate are obtained by monitoring a human body surface temperature using the infrared sensors, and comparing with a set value to adjust the outdoor air flow rate for keeping human body at a healthy level, outdoor air flow rate is adjusted by sending measured outdoor air flow rate air with the air speed sensors to an air conditioning system control center, the air conditioning system control center adjusts and controls an opening degree of the damper; supply outdoor air humidity is reduced by cooling and dehumidifying of the air source heat pump indoor finned evaporator, and a supply outdoor air temperature is raised by heating of air source heat pump indoor finned condenser.

* * * * *